United States Patent [19]

Kamiya

[11] 4,261,082

[45] Apr. 14, 1981

[54] SLIDE FASTENER FOR PREVENTING JAMMING OF FOREIGN MATTER

[76] Inventor: Minoru Kamiya, 46-3, 2-chome, Minami Otsuka, Toshima-ku, Tokyo, Japan

[21] Appl. No.: 63,548

[22] Filed: Aug. 3, 1979

[51] Int. Cl.[3] ..... A44G 19/26

[52] U.S. Cl. ..... 24/205.15 R

[58] Field of Search ..... 24/205, 205.15 R, 205.15 E

[56] References Cited

U.S. PATENT DOCUMENTS

| | | | |
|---|---|---|---|
| 1,966,255 | 7/1934 | Marinsky | 24/205.15 R |
| 2,072,200 | 3/1937 | De Vore | 24/205 |
| 2,095,270 | 10/1937 | Silberman | 24/205.15 R |
| 2,325,709 | 8/1943 | Samstegman | 24/205 |
| 2,456,822 | 12/1948 | Engel | 24/205.15 R |
| 2,810,174 | 10/1957 | Mikulas | 24/205.15 R |
| 2,824,352 | 2/1958 | Foltis | 24/205.15 R |
| 2,840,877 | 7/1958 | Foltis | 24/205.15 R |
| 2,855,652 | 10/1958 | Jones | 24/205.15 R |
| 4,121,326 | 10/1978 | Kamiya | 24/205.15 R |
| 4,142,275 | 3/1979 | Krauer | 24/205.15 R |

*Primary Examiner*—Roy D. Frazier
*Assistant Examiner*—Peter A. Aschenbrenner
*Attorney, Agent, or Firm*—Graybeal & Uhlir

[57] ABSTRACT

A slide fastener is provided with flanges projecting forwardly of the front or diverging end portion of a slider body to form a V-shape. The flanges define a pair of diagonal guide faces for guiding foreign matter inwardly toward the central bridge portion of the slider body. Fastener element-receiving openings are formed by the edges of the flanges which also form the guide faces. If foreign matter, such as waste thread, is lodged between teeth of the fastener elements, it is guided along the slider guide faces from the outer edge of the slider to the central bridge thus removing the foreign matter. As a result, jamming of the slider is prevented.

9 Claims, 16 Drawing Figures

SLIDE FASTENER FOR PREVENTING JAMMING OF FOREIGN MATTER

BACKGROUND OF THE INVENTION

1. Field of the Invention

This invention relates to a slide fastener, and more particularly to a slide fastener which prevents jamming of foreign matter into the slider of the slide fastener.

2. Brief Description of the Prior Art

A slide fastener, commonly called a zipper or chuck, is generally provided with two fastener elements and a plurality of teeth arranged in row along each inner edge of a slender tape. The fastener elements are brought together to interlock together and separate apart by the movement of the slider in one direction or the other. The slide fastener is widely used, for example, in clothing, bags, sporting goods, household necessities and so forth.

Conventional types of slide fasteners, however, have serious defects. Foreign matter such as cloth, waste thread and the like, often become jammed in the clearance provided between the element-receiving openings of the slider and fastener elements. As a result, the slider will not slide properly or may not even slide at all if foreign matter becomes jammed between the teeth of the fastener elements and then the teeth engaged with each other. As a result, not only is the slider often damaged, but also clothing, bags and the like, which utilize slide fasteners, cannot be used any more. Moreover, the jammed foreign matter, which can even be part of the clothing or bag itself, or the contents of the bag may be damaged if caught in the slider. Various types of sliders have been utilized in an attempt to prevent foreign matter from entering and thereby jamming the slider. One such type of known slider is disclosed in applicant's own U.S. Pat. No. 4,121,326 wherein the two channel openings at the diverging end of a slider are provided with inturned lips thereby reducing the clearance between the fastener elements and the slider. The lips are made from wear-resistant material and ride against the sides of the fastener elements in an attempt to prevent foreign matter from entering into the two channels.

In another type of known slider, a plow or guard is disposed forwardly of the diverging end of the slider to prevent foreign material from reaching the slider and/or pushing under and over garments downwardly and upwardly, respectively, away from the channel entrances. One type of plow utilizes a cross bar which is disposed forwardly of the diverging end of the slider to extend perpendicularly to the line of travel of the slider in an attempt to prevent materials from reaching the slider. Examples of such sliders are disclosed in DeVore U.S. Pat. No. 2,072,220 and Samstegman U.S. Pat. No. 2,325,709.

In another type of known slider, the plow is generally in the form of a finger which extends forwardly to lie between the two tapes of a slide fastener. Examples of such sliders are disclosed by Foltis U.S. Pat. No. 2,840,877 and Jones U.S. Pat. No. 2,855,652.

In a further known type of slide fastener, the plow is generally in a V-shape having side edges which extend rearwardly and oppositely laterally outwardly from a central leading point. An example of this type of slider utilizing this particular plow construction is disclosed by Engel U.S. Pat. No. 2,456,822.

In another attempt to prevent foreign material from jamming a slide fastener, the forward edge portion of the upper and lower plates, which form the channel entrances at the diverging end of the slider, have been deformed upwardly and downwardly, respectively, to form a forwardly open projection that extends a short distance generally longitudinally of the corresponding slider channel. The upper and lower slider plates also include an inwardly directed rib which extends perpendicularly to the length of each entrance channel at the base of each projection. As the diverging end of the slider is pushed forwardly to close the fastener elements, cloth or other material which may be in the path of the slider are allowed to fill the projection until such cloth bunches up against the transverse rib thereby causing the slider to come to an abrupt stop theoretically before the jammed material is damaged by ripping or tearing. An example of a slider utilizing this particular construction is disclosed by Foltis U.S. Pat. No. 2,824,352.

In another known type of slider, longitudinal grooves are formed in the inturned side flanges which extend downwardly from the upper plate and upwardly from the lower plate at the diverging end portion of the slider. The grooves are disposed generally longitudinally of the line of travel of the slider so that foreign material which enters into the channels at the diverging end of the slider will enter the longitudinal grooves and follow the path of the grooves to thereby be conveyed rearwardly out of the slider. An example of this type of slider is disclosed by Mikulas U.S. Pat. No. 2,810,174.

SUMMARY OF THE INVENTION

The primary object of the present invention is to provide a slide fastener which prevents the jamming of foreign matter within the slider when the fastener elements are engaged with each other due to the sliding operation of the slider.

Another object of the present invention is to provide a slide fastener which removes foreign matter, such as waste thread or cloth, which has become caught between the adjacent teeth of the fastener elements of a tape to avoid jamming the slider.

Still another object of the present invention is to provide a slide fastener which has flanges made of elastic material and which form resilient pressing entrances for receiving the fastener elements so that the fastener elements can be introduced into the slider through the pressing entrances under a slight pressure due to the elasticity of the elastic material, thereby preventing foreign matter from entering into the slider.

Still another object of the present invention is to provide a slide fastener constructed from metal that has been coated with an elastic material so as to form elastic flanges at the front face of the element-receiving openings of the slider body.

Still another object of the present invention is to provide a slide fastener which is encased within an elastic cover that includes flanges which form the element-receiving openings of the slider body.

Still another object of the present invention is to provide a slide fastener, including rearwardly converging flanges, which has been constructed from an elastic material.

Other objects of the present invention in addition to those mentioned above will become more apparent from reading the following détailed description of typical embodiments of the invention, taken in conjunction with the accompanying drawings.

DESCRIPTION OF THE PREFERRED EMBODIMENTS

Prior to explaining the typical embodiments of the present invention, I will explain how foreign matter often causes a conventional slide fastener to jam.

Figure 1A:
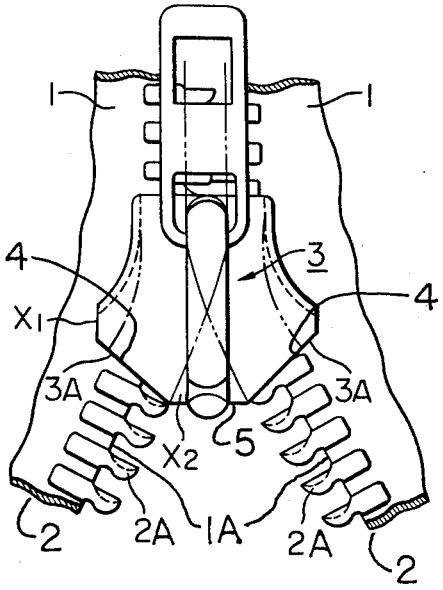
FIG. 1A PRIOR ART
FIGS. 1A and 1B illustrate a conventional slide fastener, FIG. 1A being a plan view showing a main part thereof and FIG. 1B being a front elevational view thereof.
Figure 1B:
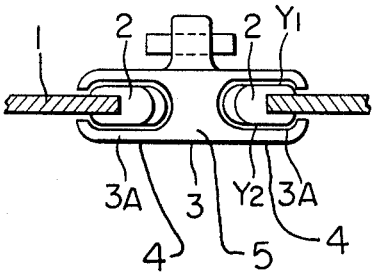
FIG. 1B PRIOR ART

In FIGS. 1A and 1B, fastener elements 2, 2 are each composed of a chain of transversely disposed teeth, 2A aligned in a row along the inner edge portions of a pair of tapes 1, 1. The teeth 2A of the fastener elements 2, 2 are longitudinally staggered relative to each other. To close or open the slide fastener, the right and left side fastener elements 2,2 are brought into engagement with or disengaged from each other by the sliding action of slider 3. The forward or diverging end of slider 3 has a pair of diagonal faces 4,4 which extend rearwardly and oppositely laterally outwardly from a transverse central bridge portion 5. The slider 3 is provided with openings 3A, 3A for receiving a fastener element at the two diagonal faces 4,4. Foreign matter, such as a piece of cloth or waste thread caught between the two fastener elements 2, 2 or between the adjacent teeth 2A of one of the fastener elements 2, 2 when pushed forwardly by the slider 3 will slide along one of the diagonal faces 4 thus forcing the cloth or thread even deeper between the teeth 2A. As slider 3 continues to pass by, the cloth or thread is driven into a slider opening 3A and then wedged between the fastener element 2 and the close fitting slider 3 thereby causing the slider 3 to become tightly jammed or stuck.

Moreover, between each receiving opening 3A of the slider 3 and each fastener element 2, as shown in FIG. 1A, clearances $X_1$ and $X_2$ are respectively provided between the slider 3 and the base of each tooth 2A and between slider 3 and the tip of each tooth 2A. As shown in FIG. 1B, clearances $Y_1$ and $Y_2$ are also provided between portions of the slider and the upper and lower sides, respectively, of each of the fastener elements 2, 2.

In general, the side clearances $X_1$, $X_2$ correspond to approximately 30–40% of the length of each fastener tooth 2A while the vertical clearances $Y_1$, $Y_2$ correspond to approximately 10–20% of the thickness of each fastener tooth 2A.

If the aforesaid ranges of the side clearances $X_1$, $X_2$ and vertical clearances $Y_1$, $Y_2$ are reduced, jamming of slider 3 due to foreign matter being caught therein is lessened and may even be avoided. However, if these clearances are appreciably reduced, the fastener element teeth 2A, 2A, which are flexibly mounted on the tapes 1, 1, respectively, will not smoothly slide through slider 3. Therefore, the aforesaid range of each clearance should be maintained in order to carry out the smooth engagement and disengagement of slide fastener elements 2, 2 with and from each other by the sliding action of slider 3 along the length of tapes 1, 1. However, such clearances permit foreign matter to become wedged within openings 3A, 3A thereby causing slider 3 to jam.

Figure 2A:
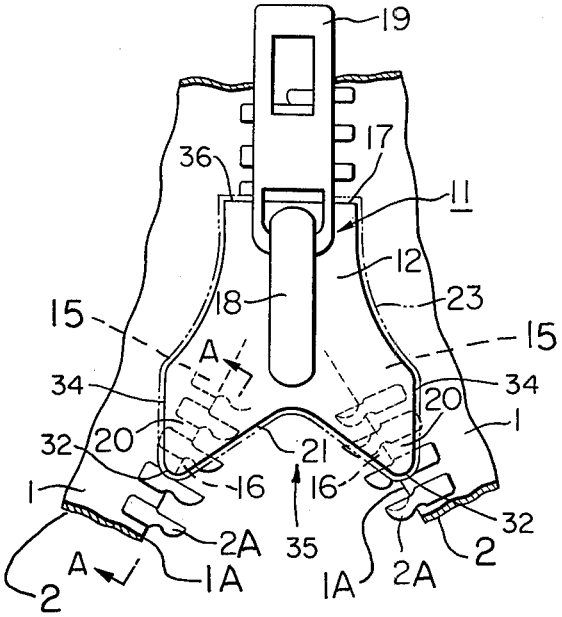
FIGS. 2A–2C illustrate a typical first embodiment of a slider constructed according to the present invention, FIG. 2A being a plan view thereof, FIG. 2B being a front elevational view thereof, and FIG. 2C being an enlarged cross section thereof taken along the line A—A of FIG. 2A.
Figure 2B:
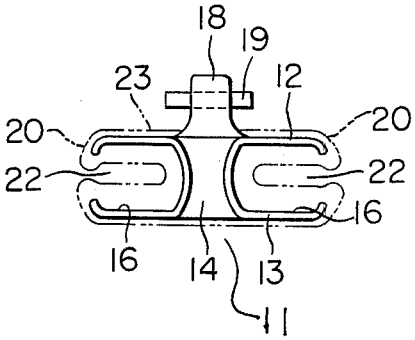

A first typical embodiment of the present invention is shown in FIGS. 2A and 2B. Namely, a slider body 11 comprises an upper plate 12 and a lower plate 13 suitably made of metal or synthetic resin, and a laterally centrally located connecting web 14 which connects plates 12, 13 together at the diverging or forward end portion 35 of slider 11. At both side edges of the diverging end of slider body 11 are entrance channels 15, 15 which are open at their individual front ends and at their common rear end to receive tapes 1, 1. Rather than having diagonally rearwardly directed faces 4,4 as shown in FIGS. 1A and 1B, the forward end of slider body 11 includes a pair of flanges 20, 20 which are formed by projecting the front edge portions of the upper and lower plates 12, 13 of the slider body 11 forwardly and laterally outwardly of the connecting web 14. As a result, the forward end portion of slider body 11 assumes a forwardly convex, V-shape thereby defining a pair of rearwardly converging, diagonal guide faces 21, 21. Faces 21, 21 extend forwardly and oppositely laterally outwardly from connecting web 14 which forms the base or root of the V-shaped front end portion of slider body 11 to a rounded forward tip 32. The guide faces 21, 21 both extend laterally outwardly from central web 14 to at least the location at which the teeth 2A, 2A of each of the two fastener elements 2, 2 intersect the inwardly disposed edge 1A, 1A of its corresponding tape 1, 1. From forward tips 32, flanges 20, 20 of upper plate 12 and flanges 20, 20 of lower plate 13 extend rearwardly along edges 34, 34 to intersect the corresponding sides of slider body 11.

Openings 16, 16 for receiving the fastener elements 2, 2 (element-receiving openings) within channels 15, 15 are formed at the front end portion of each flange 20, 20. A portion of each element-receiving opening 16, 16 extends along the length of each guide face 21 so that tip portions of the fastener element teeth 2A, which project inwardly from the tapes 1, 1, are received into the slider body 11 through the portion of element-receiving openings 16, 16 located along guide faces 21, 21.

The widths of the upper and lower plates 12, 13 are gradually reduced from a maximum at the tips 32 of forwardly protruding flanges 20, 20 to a minimum at the rear edge of the slider body. A rear opening 17 through which the fastener elements exit after they have been locked together is provided at the rear edge 36 of slider body 11. A fitting rod 18 is provided on the central portion of the upper surface of the upper plate 12 and a hook 19 is attached to the fitting rod 18 for pulling slider 11. The upper and lower plates 12, 13 and the central connecting web 14 which basically constitute the slider body 11 may be integrally formed by cast-work or press-work or may be separately manufactured and then assembled together to form slider body 11.

Figure 2C:
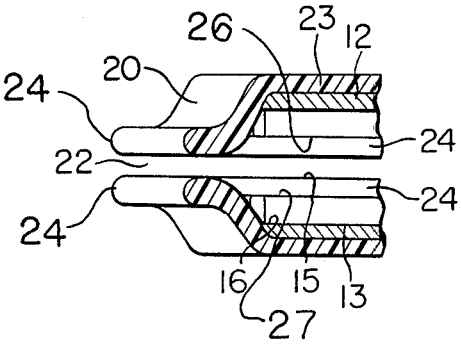

The outer surface of the slider body is covered with a wear-resistant synthetic resin coating 23 (for example, Teflon and the like) (shown in broken line) by means of dipping. And especially, each element-receiving opening 16 as formed by flanges 20 is covered with the coating 23. As shown in FIG. 2C, the open front edges 26 and 27 of channels 15, 15 of slider 11 are coated. The coating 23 extends downwardly from the open front edge 26 of upper plate 12 and upwardly from the open front edge 27 of lower plate 13 to form lip portions 24. The lip portions 24 define a pressing entrance 22 in the shape of a lateral groove at each element receiving opening 16, 16. The vertical height of pressing edges 22 is smaller than the thickness of fastener elements 2, 2. The width of the pressing entrance 22 is wide enough to extend beyond the ends of the fastener element teeth 2A, 2A as they are pressurizedly received through entrances 22, 22.

As the fastener elements 2, 2 enter into the moving slider body 11 through pressing entrances 22 to be thereby locked together. Any waste thread, cloth or other foreign matter that is caught in between the teeth 2A, 2A of the fastener elements 2, 2 is precluded from entering receiving openings 16, 16 of channels 15, 15 by the pressing action of elastic lip portions 24 against the teeth 2A, 2A. Furthermore, foreign matter which is caught between the teeth of each of the fastener elements 2, 2, is pushed toward the tips of the teeth 2A, 2A by the diagonally disposed guide faces 21 formed by flanges 20, 20 as fastener elements 2, 2, enter slider body 11. Once free from teeth 2A, 2A, the foreign matter slides further inwardly along the diagonal guide faces 21, 21 toward central web 14 thereby preventing it from entering into channels 15, 15 of slider body 11.

Figure 3A:
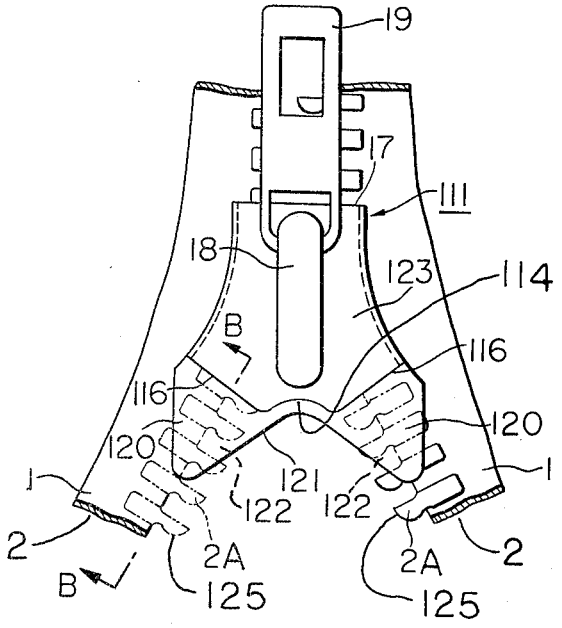
FIGS. 3A–3C illustrate a second typical embodiment of a slider constructed according to the present invention, FIG. 3A being a plan view thereof, FIG. 3B being a front elevational view thereof, and FIG. 3C being a cross-sectional view thereof, taken along the line B—B of FIG. 3A.
Figure 3B:
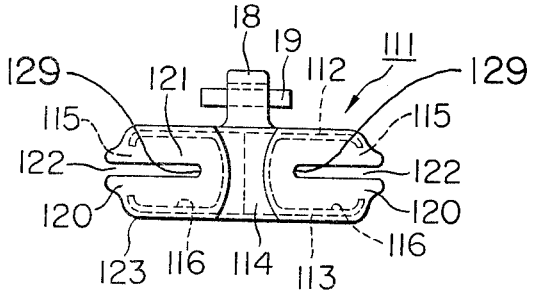
Figure 3C:
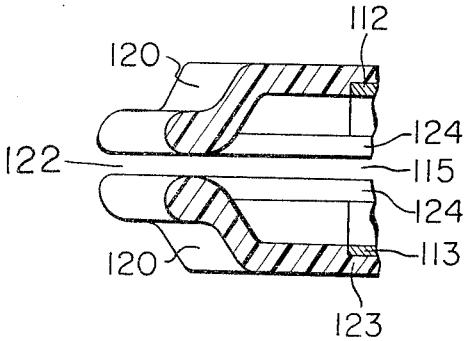

Another typical embodiment of the present invention is illustrated in FIG. 3A, wherein the outer surface of a conventionally shaped slider body 111 is covered by an elastic coating 123 of preferably wear-resistant synthetic resin. Flanges 120, 120, which are formed by the elastic material 123 protrude forwardly of the slider body guide openings 116, 116, which openings are formed by upper and lower plates 112, 113 and a connecting web 114 in a manner similar to that shown in FIGS. 2A–2C. As a result of flanges 120, the front or forward end portion of slider body 111 is formed in a forwardly convex, V-shape and defines a pair of diagonal guide faces 121 extending forwardly and oppositely laterally outwardly from connecting web 114 which forms the base or root of such V-shape. The edges of the upper and lower surfaces of flanges 120 are turned in towards each other to form lip portions 124. Lip portions 124 define laterally extending pressing entrances 122, 122 which have a vertical height less the vertical height of element introducing openins 116, 116 at the front of slider body 111. Flanges 120 are made from elastic material of synthetic resin and, as shown in FIG. 3C, are preferably thicker than the thickness of upper and lower plates 112 and 113, respectively. Preferably the same is true for lips 124. In the typical embodiment illustrated in FIGS. 3A–3C, as the fastener elements 2, 2 are received into entrances 122, 122, lips 124 press against the upper and lower surfaces of teeth 2A, 2A. Also, the ends 129 of the pressing entrances 122 brush against the tips 125 of teeth 2A, 2A. Thus, any portion of a garment or other materials, such as loose threads, which is disposed between the two slider elements 2, 2 or which is even caught between the teeth 2A of one of the fastener elements 2, 2 is prevented from entering into openings 116, 116 to thereby jam slider body 111.

Moreover, the foreign material which may be disposed between the teeth 2A of fastener elements 2, 2 is actually removed therefrom by the action of diagonal guide faces 121 pushing against such material in the same manner as that described above.

Figure 4A:
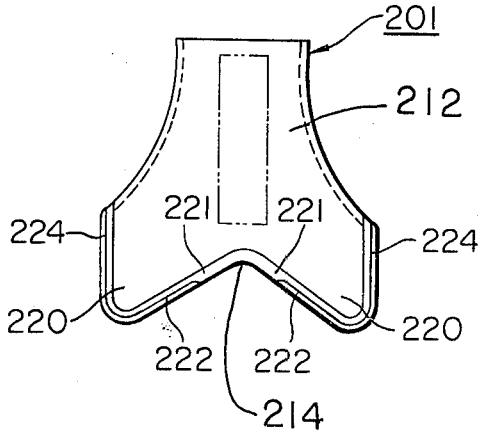
FIGS. 4A and 4B illustrate a third typical embodiment of a slider constructed according to the present invention, FIG. 4A being a plan view thereof, and FIG. 4B being a front elevational view thereof.
Figure 4B:
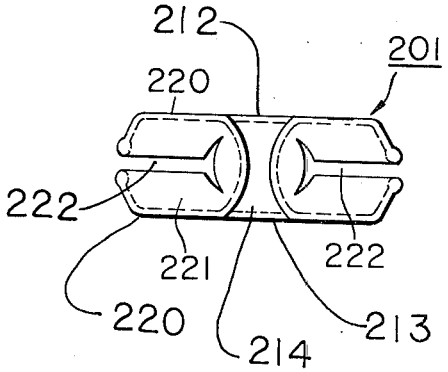

FIGS. 4A and 4B illustrate still another typical embodiment of the present invention. Basically, in this typical embodiment, a cover 201 made of an elastic material of synthetic resin such as polyamide resin, Teflon resin, rubber and the like is initially molded. Thereafter, the elastic cover 201 is inserted over a conventional slider body such as body 3 in FIGS. 1A and 1B. Cover 201 is constructed with an upper member 212 and a lower member 213 connected together by a central bridge or connecting portion 214 to form a hollow shape corresponding to the shape of a conventional slider body. Cover 201 is similar to the aforementioned typical embodiments of the present invention in that a pair of diagonally disposed guide faces 221 extend forwardly and oppositely laterally outwardly from central connecting portion 214 which is formed at the front end portion of cover 201. Also, forwardly directed pressing entrances 222, 222 are formed at guide faces 221, 221 by resilient lips 224 which extend inwardly toward each other from the edges of the upper and lower surfaces of flanges 220. Thus, the flanges 220 also include pressing entrances 222 which prevent a conventional slide fastener from being jammed by foreign material.

Figure 5A:
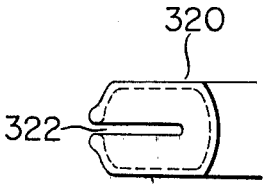
FIGS. 5A–5C illustrate front elevational views showing principal parts of flanges with various types of pressing entrances.
Figure 5B:
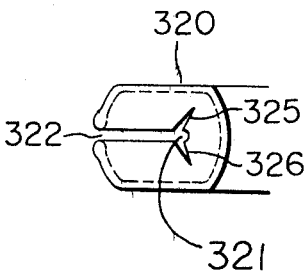
Figure 5C:
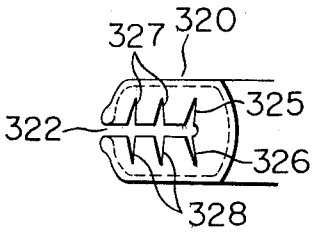

FIGS. 5A–5C show various typical embodiments of pressing entrances 322. In FIG. 5A, a pressing entrance 322, which is open along its outside edge, is formed in the shape of a rectangular laterally extending groove located at the front face of slider flanges 320 which is preferably formed from elastic material.

In FIG. 5B, upwardly and downwardly extending oblique cuts 325, 326 are provided at the laterally inward end portion 321 of pressing entrance 322 so as to improve its flexibility when fastener elements enter therethrough. Furthermore, in FIG. 5C a plurality of parallel cuts 327, 328 are located on the upper and lower edge portions of the pressing entrance 322.

Figure 6A:
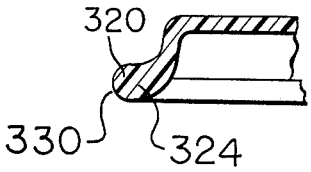
FIGS. 6A–6C illustrate enlarged cross-sectional views of principal parts of flanges formed in various shapes.
Figure 6B:
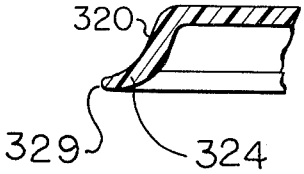
Figure 6C:
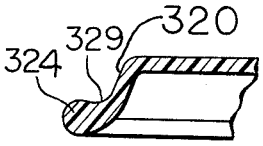

FIGS. 6A–6C show various cross-sectional views of the lip portion 324 of flange 320 as taken along a line similar to line A–A in FIG. 2A. FIG. 6A shows an upper lip 324 of flange 320 which is semi-circular in cross section and which has a smooth fastener element contacting surface 330. In FIG. 6B, lip 324 projects inwardly and forwardly of flange 320 to terminate at edge 329 which is thinner than the thickness of said lip 324. FIG. 6C shows a flange 320 which is connected to a relatively thick, semi-circular shaped lip 324 by a thinner, intermediate portion 329 which thus improves the elasticity of flange 320.

Of course, the present invention is not limited only to the above-mentioned forms. Needless to say, if elastic material is used to form the flange portions of the present invention, any specific form of flanges may be used as long as such flanges press against the upper and lower surfaces of the fastener elements as they enter into the slider body thus preventing the jamming of the slider by foreign matter. The resilient flanges permit the fastener elements to smoothly enter the slider body while keeping out foreign material.

As mentioned above, according to the present invention a pair of flanges project forwardly from the front face of the slider to form a pair of diagonal guide faces which extend forwardly and laterally outwardly in opposite directions from a central bridge portion. Thus, any foreign matter which may be located between the two fastener elements or which may be caught between the teeth of either fastener element is removed therefrom by the diagonal guide faces which guide the foreign material toward the closed central bridge of the forward end portion of the slider.

Moreover, foreign matter can be prevented from entering into the slider and jamming it. This is accomplished by constucting the slider with pressing entrances of a nominal size smaller than the size of the teeth of the fastener elements. A resilient lip surrounds the pressing entrance to make sliding contact with the upper and lower surfaces and with the tip end of the teeth of the fastener elements.

Therefore, the present invention prevents foreign materials from entering into a slider of a slide fastener to jam or otherwise damage the slide fastener while at the same time not comprising the smooth sliding movement of the slider as it opens and closes the slide fastener. Thus, damage to clothing bags, sporting goods and the like which utilize slide fasteners is avoided.

What is claimed is:

1. In a slide fastener having two longitudinal fastener elements, each including teeth arranged along a tape, and a slider body slidable along the two fastener elements, the slider body having a diverging, forward end portion for individually, slidably receiving the two fastener elements to be locked together within the slider body, and a rearward end portion for jointly exiting the two fastener elements after being locked togther, the slider body further including an upper plate, a lower plate vertically spaced below the upper plate, and a central web interconnecting said two plates laterally centrally at the forward end portion of the slider body to partition the forward end portion slider body into a pair of laterally spaced apart channels, the improvement comprising:

the upper and lower slider body plates each including a pair of flanges laterally spaced apart on opposite sides of said central connecting web and extending forwardly, and outwardly of said central connecting web to form a generally forwardly directed extension of corresponding upper and lower plates at the diverging end of the slider;

resilient lips extending along the perimeter of the two laterally spaced apart flanges of each of the upper and lower plates with the lips of the two flanges of the upper plate extending downardly toward the upwardly extending lips of the two flanges of the lower plate;

the flanges and corresponding lips of the upper and lower plates at each side of the central connecting web:

defining a generally forwardly directed opening for a corresponding channel through which opening a corresponding slide fastener element enters the slider body at one side of the central connecting web, with the gap separating the corresponding lips of each forwardly directed opening narrower than the thickness of the teeth of the fastener elements; and forming a diagonal guide face, with said two diagonal guide faces extending forwardly of the diverging end of the slider and oppositely laterally outwardly from the slider central web and across to at least the location at which the teeth of the fastener elements intersect the inwardly disposed edge of its corresponding tape to catch threads and other foreign material lodged between adjacent teeth of the fastener elements.

2. The improvement according to claim 1, wherein each of said flanges is constructed from elastic material.

3. The improvement according to claim 2, wherein cuts are provided in portions of said resilient lips to increase the flexibility of said lips.

4. The improvement according to claim 1, wherein the slide fastener body and said flanges are integrally formed from elastic material.

5. The improvement according to claim 4, wherein cuts are provided in portions of said resilient lips to increase the flexibility of said lips.

6. The improvement according to claim 1, wherein the outer surface of the slider body is coated with an elastic material with portions of said material forming said resilient lips.

7. The improvement according to claim 6, wherein cuts are provided in portions of said resilient lips to increase the flexibility of said lips.

8. In a slide fastener having a pair of longitudinal fastener elements, each including a chain of teeth aligned along the length of a tape; and a slider body having a diverging, forward end portion individually receiving the two fastener elements to be locked together and a rearward end portion for exiting the two fastener elements from the slider body after being locked together, the slider body further including an upper plate, a lower plate spaced below the upper plate and a laterally, centrally disposed connecting web connecting the two plates together at the forward end portion of the slider body to longitudinally divide the slider body into a pair of laterally spaced channels for individually receiving the two fastener elements, the improvement comprising a cover emplaceable over the slide body, said cover having an upper member for overlying the slider upper plate, a lower member for underlying the slider lower plate, and a laterally centrally located connecting web interconnecting said two cover members at a location forwardly adjacent the connecting web of the slider body, each of said upper and lower cover members having a pair of flanges laterally spaced apart on opposite sides of said cover central connecting web and extending forwardly of a corresponding slider body upper and lower plate at the diverging end of said slider, and having resilient lips extending along the perimeter to the two laterially spaced apart flanges of each of the upper and lower cover members, with the lips of the two flanges of the upper plate extending downwardly toward the upwardly extending lips of the two flanges of the lower plate, the flanges and the corresponding lips of the upper and lower cover members at each side of said central cover connecting web:

forming a generally forwardly directed opening for a corresponding slider channel, through which opening a corresponding slide fastener element enters the slider body at one side of the cover central connecting opening, with the gap separating the lips of each opening being narrower than the thickness of the teeth of the fastener elements, and forming a diagonal guide face, each of which extends forwardly of the diverging end of the slider and oppositely, laterally outwardly from the slider central connecting web and across the width of a corresponding fastener element to at least the location at which the teeth of the fastener elements intersect the inwardly disposed edge of its corresponding tape.

9. The improvement according to claim 8, wherein cuts are provided in portions of said elastic lips to increase the flexibility of said lips.

* * * * *